US005420673A

United States Patent [19]

Itoh

[11] Patent Number: 5,420,673

[45] Date of Patent: May 30, 1995

[54] DRYING DEVICE FOR ELECTROSTATIC RECORDING APPARATUS

[75] Inventor: Kazuhiko Itoh, Tokyo, Japan

[73] Assignee: Nippon Steel Corporation, Tokyo, Japan

[21] Appl. No.: 88,532

[22] Filed: Jul. 9, 1993

[30] Foreign Application Priority Data

Jul. 9, 1992 [JP] Japan ..... 4-205995
Oct. 20, 1992 [JP] Japan ..... 4-306587

[51] Int. Cl.[6] ..... G03G 15/10

[52] U.S. Cl. ..... 355/256; 34/635; 34/653

[58] Field of Search ..... 355/256; 118/662; 34/155, 156, 160

[56] References Cited

U.S. PATENT DOCUMENTS

| | | | |
|---|---|---|---|
| 3,805,409 | 4/1974 | Sato et al. | 34/160 X |
| 4,290,210 | 9/1981 | Johansson | 34/156 |
| 4,601,116 | 7/1986 | Krimsky | 34/156 |
| 4,870,462 | 9/1989 | Day | 355/256 |
| 5,016,036 | 5/1991 | Nishikawa . | |
| 5,020,244 | 6/1991 | Smith | 34/160 X |
| 5,023,665 | 6/1991 | Gundlach | 355/256 |
| 5,063,413 | 11/1991 | Domoto et al. | 355/256 X |
| 5,157,443 | 10/1992 | Anderson et al. . | |
| 5,181,329 | 1/1993 | Devaney et al. | 34/160 X |

FOREIGN PATENT DOCUMENTS 0165886 12/1985 European Pat. Off. .

OTHER PUBLICATIONS

Patent Abstracts of Japan, vol. 7, No. 30, Feb. 5, 1983, & JP-57-182764, Nov. 10, 1982, Tokyo Shibaura Denki.

Journal of Imaging Technology, vol. 13, No. 2, Apr. 1987, Springfield US, pp. 68-74.

*Primary Examiner*—R. L. Moses
*Attorney, Agent, or Firm*—Pollock, Vande Sande & Priddy

[57] ABSTRACT

A drying device, for use with an electrostatic recording apparatus arranged such that an electrostatic latent image of an image to be recorded is formed on a surface of a recording paper moving through a predetermined moving path and the latent image is developed by applying a liquid toner to the surface of the recording paper and for drying the recording paper after application of the liquid toner, includes an air blower or suction unit for supplying or drawing an air; and an air guiding mechanism for guiding the air from the air blower to outside or from outside to the air suction unit through an area adjacent to the surface of the recording paper, wherein the air guiding mechanism includes an air passage extending from the air blower or the air suction unit to the predetermined moving path and an opening defined between at least by a part of a side wall of the air passage and the surface of the recording paper moving through the predetermined path for allowing the air to pass therethrough to outside or the air suction unit and the opening has a size sufficiently smaller than a size of a cross-section of the air passage perpendicular to a direction in which the dry air flows through the air passage to regulate flow of the dry air when passing the opening.

9 Claims, 4 Drawing Sheets

DRYING DEVICE FOR ELECTROSTATIC RECORDING APPARATUS

FIELD OF THE INVENTION

This invention relates to a drying device for recording paper used in an electrostatic recording apparatus, and more particularly to a drying device for drying recording paper on which an image has been developed with a liquid toner in an electrostatic recording apparatus for recording an image by developing with a liquid toner an electrostatic latent image formed by an electrostatic recording head.

BACKGROUND OF THE INVENTION

In the conventional color electrostatic recording apparatus, for example, in Nippon Steel's "A0-size single pass color electrostatic plotter X2020", as shown in FIG. 1, the recording paper wound on a drum 10 is drawn out and fed by a feeder roller 20 at a given speed, and passes through four primary color recording sections for black, cyan, magenta, and yellow. When passing each primary color recording section, an image of the corresponding color component is recorded on the recording paper. More particularly, as shown in FIG. 2, as the recording paper 1 passes each primary color recording section, the electrostatic latent image of the image of the respective color component is recorded on the recording side of the recording paper 1 by the electrostatic recording head 2. At a liquid development unit 4, a liquid toner of the respective color is carried with spiral grooves (not shown) formed in the surface of a rotating toner roll 4*a*, and applied to the recording side of the recording paper 1. Since the liquid toner is charged in a polarity opposite to the polarity of the charge on the electrostatic latent image, the toner adheres to the portions of the recording paper where the latent image is formed. The recording paper 1 is moved further, and an excess toner is removed by the toner vacuum channel 5, and the recording paper is dried by the drying device.

The drying device includes a plurality of air blowers 56, and a dry air supplied from the air blowers 56 passes through a passage 54, and is blown against the rear surface of the recording paper 1. The dry air blown against the recording paper 1 is exhausted through an opening 60 formed between an upper end of a side wall 58 and the recording paper 1 to the outside or exhaust chamber 62. The liquid toner is mainly dried by the dry air in contact with the recording paper 1 when the dry air passes near the opening 60. However, since the volume and the direction of the air passing through the opening are not uniform in the width-wise direction of the recording paper 1, there occur turbulence or stagnation in the drying air so that the unevenness occurs in the drying of the liquid toner, which results in the unevenness of the image recorded on the recording paper 1. It is considered that this is because the drying air is blown against the recording paper and immediately diffused. Pressure rolls 4*b* are provided to prevent the recording paper 1 from being raised by the dry air and separated from the toner vacuum channel 5, and thereby to keep the paper in close contact with the toner roll 4*a* and the vacuum channel 5.

FIG. 3 shows an example of the uneven quality of the image recorded on the recording paper 1. This example shows the insufficiently dried portions 51 in the width-wise direction of the recording paper 1, namely, both edges of the paper and the other portions corresponding to the top of each of the blowers and the intermediate spaces between adjacent two blowers. The toner is generally fixed on the paper as dried. However, if the wet or insufficiently dried portion exists, the toner fixed on the wet portion is resolved at the following developer and also the wet portion may cause insufficient discharge for recording the latent image for different color by the head of the following developer. Sometimes, the toner fixed on the wet portion is scraped and fixed on the head surface and piled up thereon causing shortage of electrodes of the head, resulting in damage of the head.

In this prior art example, the recording paper width is 914 mm, the transport speed 12.7 mm/sec, the air flow rate 5 $m^3$/min, the width of the passage 54 (distance in the moving direction of the recording paper) 20 mm, and the width of the opening 60 (the distance between the upper end of the side wall 58 and the recording paper 1) 50 mm.

Another problem with the drying device of the conventional electrostatic recording apparatus using a liquid toner is in the recovery of the organic solvent used in the liquid toner. Since a liquid toner has toner particles dispersed in a liquid organic solvent, the recording paper is wetted by the solvent. Generally, in the current apparatus of the liquid development system, an excess solvent is recovered, but because of drying with dry air that follows, part of the organic solvent is discharged together with the exhaust gas. As it is not desirable from an environmental point of view that the solvent is diffused in the air, the development of a recovery system has been studied which recovers the solvent from the apparatus while increasing air-tightness, and providing a limited outlet to the outside. Recently, the trend has been toward adoption of recovery system of this type, particularly with small-size printers.

However, with the apparatus of a type using dry air blowing, it is difficult to satisfactorily recover a solvent such as Isopar contained in the exhaust air and it is feared that this type of apparatus has adverse affects on the environment.

SUMMARY OF THE INVENTION

An object of the present invention is to provide a drying device for an electrostatic recording apparatus in which the air quantity and the air flow direction of the dry air when it contacts the recording paper are uniform in the width-wise direction of the recording paper.

Another object of the present invention is to provide a drying device for an electrostatic recording apparatus capable of satisfactorily recovering the solvent contained in the exhaust dry air.

According to one aspect of the present invention, a drying device, which is for use with an electrostatic recording apparatus having means for forming an electrostatic latent image of an image to be recorded on a surface of a recording paper moving through a predetermined moving path and means for developing the latent image by applying a liquid toner to the surface of the recording paper and for drying the recording paper after application of the liquid toner, comprises: air blowing means for supplying a dry air and air guiding means for guiding the dry air supplied from the air blowing means so as to cause the dry air to blow against the surface of the recording paper moving through the predetermined moving path and to be exhausted to outside, wherein the air guiding means includes means for defining an air passage extending from the air blowing means to the predetermined moving path and an opening defined by the air passage defining means and the surface of the recording paper moving through the predetermined path for allowing the dry air, after blowing against the surface of the recording paper, to pass therethrough to outside. The opening has a size smaller than a sectional area of a cross-section of the air passage perpendicular to a direction in which the dry air flows through the air passage sufficiently to regulate flow of the dry air when passing the opening.

According to another aspect of the present invention, a drying device, which is for use with an electrostatic recording apparatus having means for forming an electrostatic latent image of an image to be recorded on a surface of a recording paper moving through a predetermined moving path and means for developing the latent image by applying a liquid toner to the surface of the recording paper and for drying the recording paper after application of the liquid toner, comprises: air suction means for drawing an external air and air guiding means for guiding the external air so as to cause the air to blow against the surface of the recording paper moving through the predetermined moving path and to be suctioned by the air suction means, wherein the air guiding means includes means for defining an air passage extending from the air suction means to the predetermined moving path and an opening defined by the air passage defining means and the surface of the recording paper moving through the predetermined path for allowing the external air, after blowing against the surface of the recording paper, to pass therethrough into the air passage. The opening has a size smaller than a size of a cross-section of the air passage perpendicular to a direction in which the dry air flows through the air passage sufficiently to regulate flow of the external air when passing the opening.

In one aspect of the present invention, the air guiding means for guiding an air used for drying the surface of the recording paper moving through the predetermined moving path and wetted by a liquid toner comprises means for defining an air passage extending from air blowing means or air suction means to the predetermined moving path and an opening defined by the air passage defining means and the surface of the recording paper moving through the predetermined moving path wherein the opening has a size smaller than a size of a cross section of the air passage in a direction in which the air flows through the air passage sufficiently to regulate flow of the air when passing the opening, whereby the flow rate and direction of the air is uniformly distributed in a width-wise direction of the recording paper at an area near to the opening where the dry air can most effectively dry the solvent of liquid toner adhered to the surface of the recording paper so that the solvent is dried uniformly over the width-wise direction of the recording paper, thereby providing a high-quality record of the image.

In another aspect of the present invention, since the dry air is drawn in the air passage from outside, the solvent of the liquid toner contained in the dry air can be recovered easily, thereby reducing the adverse effects on the environment.

DESCRIPTION OF THE PREFERRED EMBODIMENTS

Figure 4:
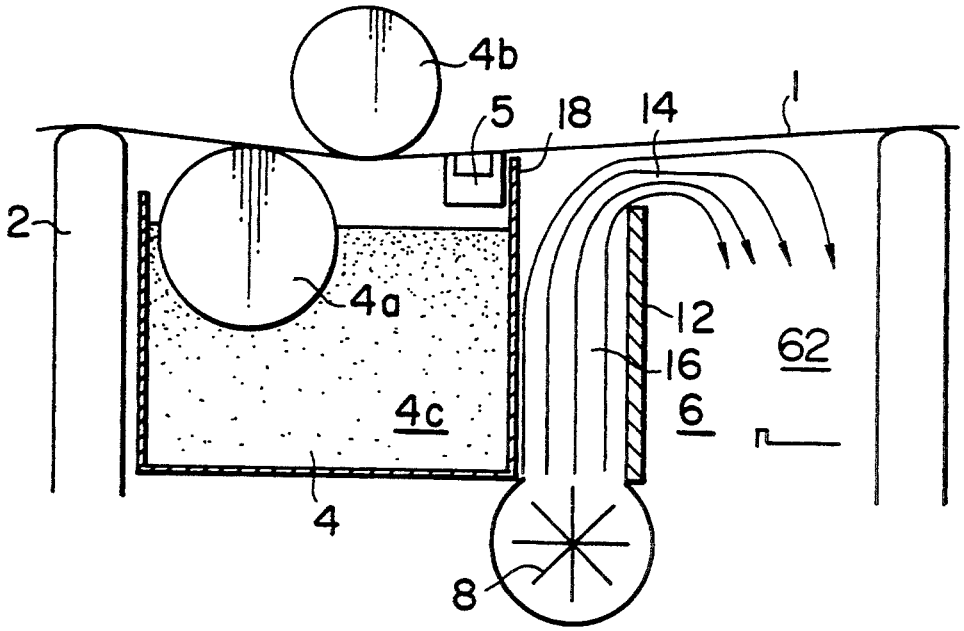
FIG. 4 is a sectional view showing the construction of the drying device according to a first embodiment of the present invention.

FIG. 4 is a sectional view showing a part of an electrostatic recording apparatus in which a drying device according to a first embodiment of the present invention is mounted. Reference numeral 1 denotes a recording paper moving through a predetermined moving path, 2 denotes an electrostatic recording head for forming an electrostatic latent image of an image, which is to be recorded on a surface of the recording paper, 4 denotes a liquid development unit, 5 denotes a vacuum suction unit for removing an excess liquid toner adhered to the recording paper, and 6 denotes a drying device for drying the liquid toner adhered to the recording paper. In the liquid development unit 4, a liquid toner **4*c* of a specified color is carried with spiral grooves (not shown) formed in the surface of the toner roller 4*a* rotatable counterclockwise, and applied to the surface of the recording paper 1. The liquid toner 4*c* is replenished to the development unit 4 from a tank (not shown) as occasion demands. The toner of the liquid toner is preliminarily charged in a polarity opposite to the polarity of the charge of the electrostatic latent image, and the toner adheres to the portions of the recording paper where the electrostatic latent image is formed, so that the electrostatic latent image is developed into a visible image. On the other hand, an excess liquid toner applied to other portions is removed by the vacuum suction unit 5**.

Figure 5:
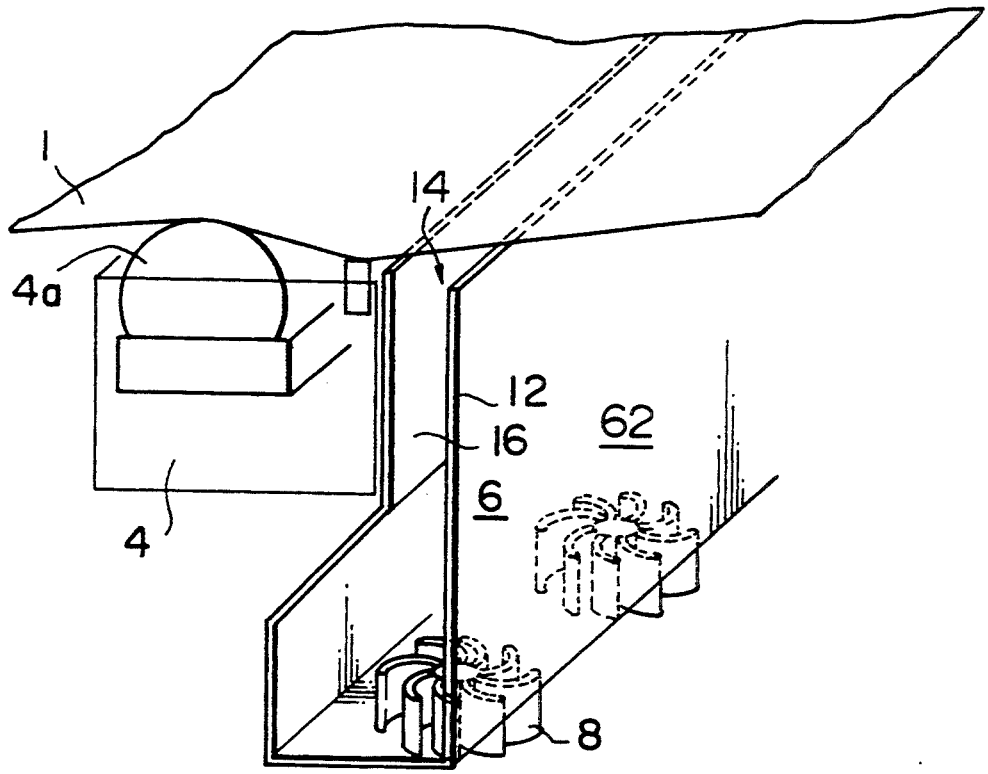
FIG. 5 is a sectional perspective view showing the construction of the drying device according to the first embodiment of the present invention.

The drying device 6, as shown in FIG. 5, has a plurality of air blowers 8, by which a dry air flows through the passage 16 and is blown against the surface of the recording paper. The passage 16, defined by side walls 12, 18, has a substantially rectangular cross section having two parallel sides parallel to the widthwise direction of the recording paper and perpendicular to the direction in which the air flows through the passage 16. The dry air blown against the surface of the recording paper 1 is exhausted to the outside or exhaust chamber 62 through an opening 14 defined by the upper end of the side wall 12 and the recording paper 1.

Figure 1:
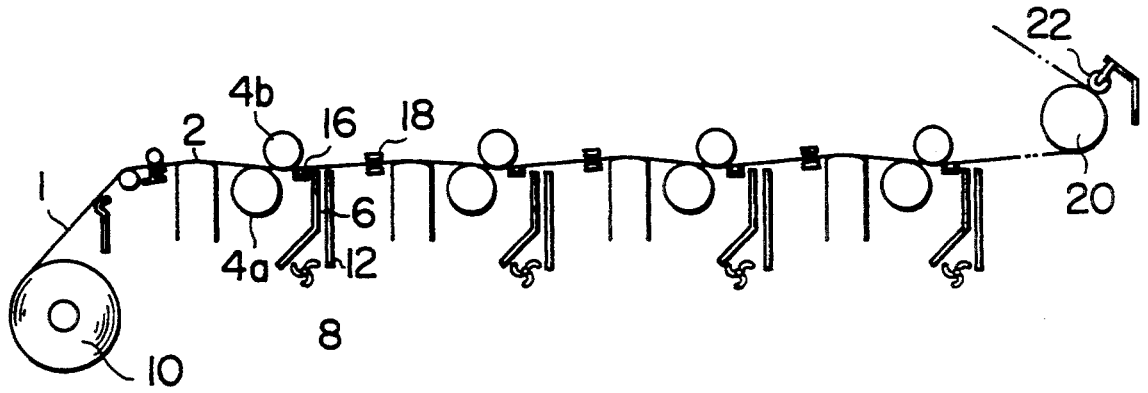
FIG. 1 is a diagram showing a schematic construction of a color electrostatic recording apparatus to which the present invention is applied.
Figure 2:
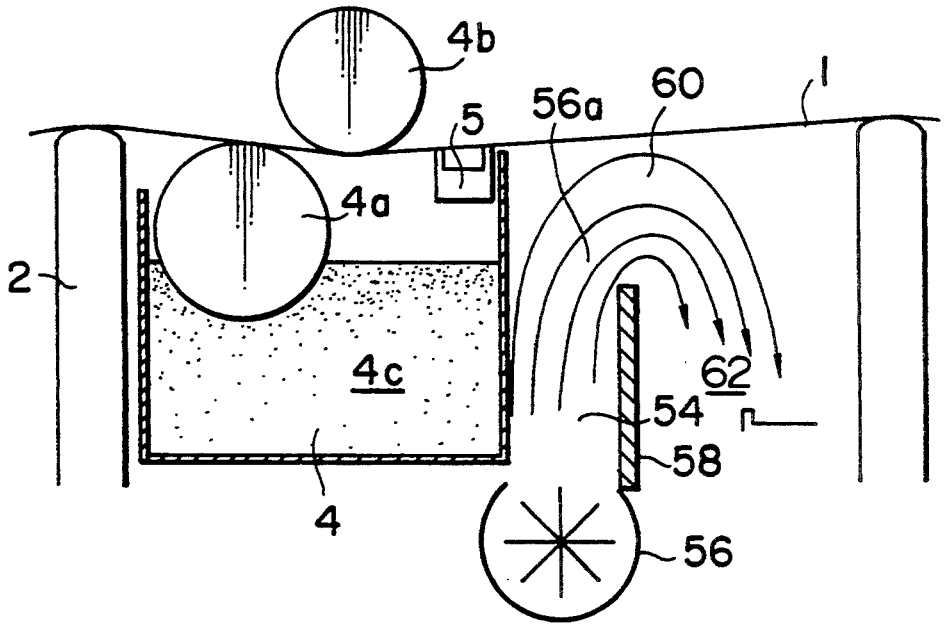
FIG. 2 PRIOR ART
FIG. 2 is a sectional view showing the construction of the conventional drying device.
Figure 3:
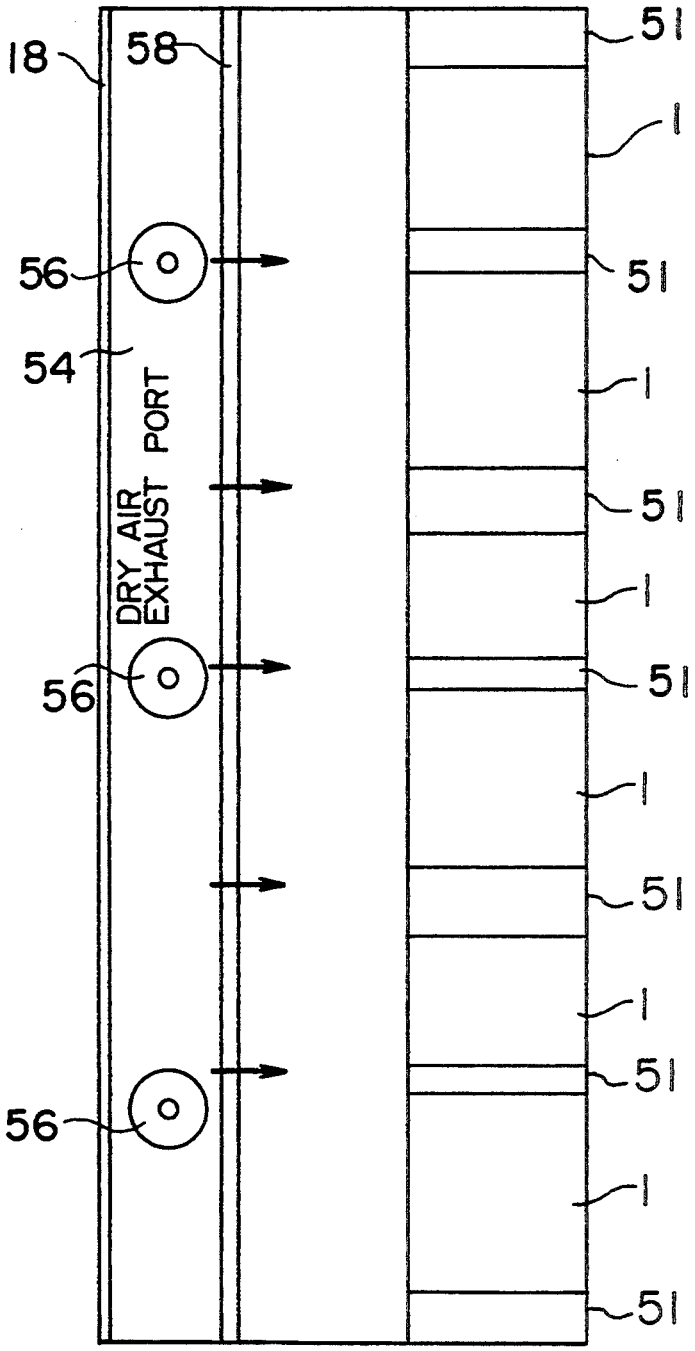
FIG. 3 PRIOR ART
FIG. 3 is a diagram showing an example of the dried state of the recording paper dried by the conventional drying device.

The opening 14 is defined by the upper end of the side wall 12 and the recording paper 1 in a substantially rectangular shape having two parallel sides parallel to the width-wise direction of the recording paper and a size smaller, preferably smaller than ½ of, the sectional area of the cross-section of the passage 16. For example, when the width between the two parallel sides of the cross-section of the passage 16 as shown in FIG. 4 is the same as that of the passage 54 of the conventional drying device in FIG. 2, that is 20 mm, the width of the opening 14 between the two parallel sides thereof (distance between the upper end of the side wall 12 and the surface of the recording paper) is 10 mm or less in the drying device of FIG. 4, in contrast to the width of the opening 60 in the conventional drying device shown in FIG. 2 which is about 50 mm. Therefore, in the drying device of the present invention, the dry air is kept at a high pressure in the passage 16 and forcibly blown out through the opening 14 so that the flow of the air is regulated at the opening to make the flow rate and direction of the air at the opening uniform in the widthwise direction of the recording paper, thereby drying the liquid toner on the recording paper uniformly in its width-wise direction. Thus, an image of high quality with no irregularity can be obtained.

Meanwhile, the recording paper width and transport speed, and the air flow rate are the same as those in the conventional device.

In the above-mentioned embodiment, description has been made of the drying device used in an electrostatic recording device including a liquid development unit using a toner roll, but the same effect can be obtained with an electrostatic recording apparatus having an overflow type liquid development unit.

Figure 6:
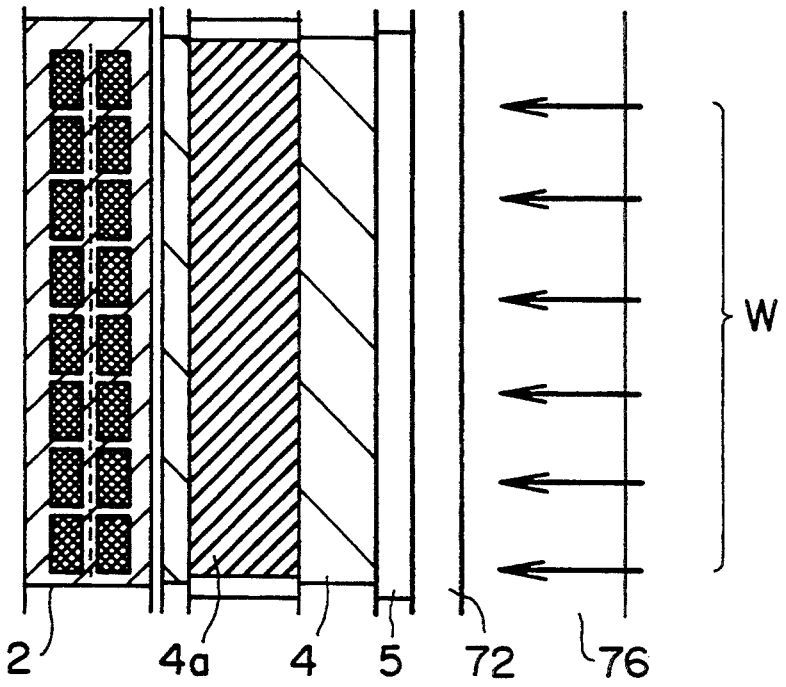
FIG. 6 is a plan view showing the construction of the drying device according to a second embodiment of the present invention.
Figure 7:
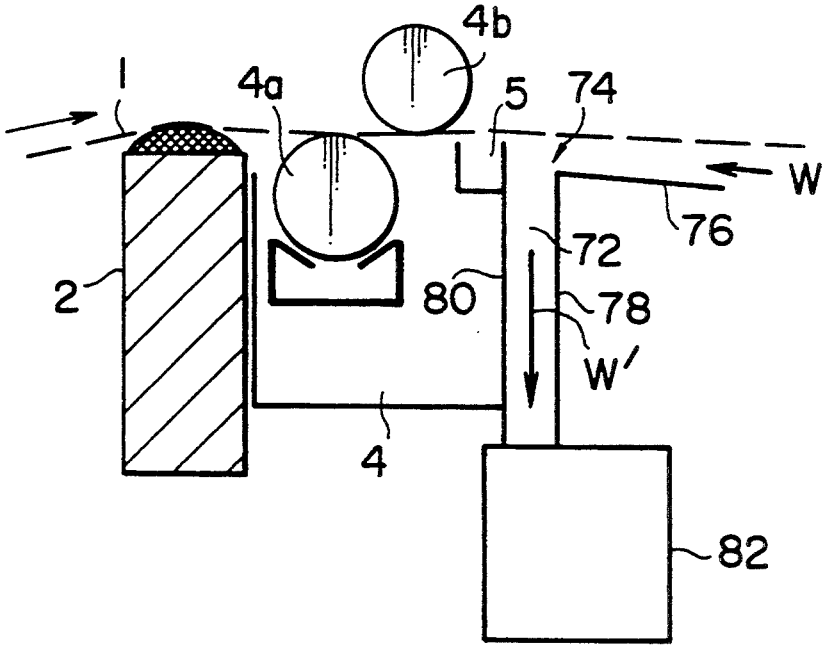
FIG. 7 is a sectional view showing the construction of the second embodiment of the present invention.

A drying device according to a second embodiment of the present invention will next be described with reference to FIGS. 6 and 7. The only difference between the second embodiment and the first embodiment is the flow direction of the dry air. In the second embodiment, dry air is drawn in from outside, through an opening 74 and a passage 72, into a suction unit 82. The passage 72 is defined by side walls 78, 80, to have a substantially rectangular cross section perpendicular to a flow direction of the air in the passage. The opening 74 is defined between the upper end of the side wall 78 and the surface of the recording paper moving through the predetermined moving path in a substantially rectangular shape. In the embodiment of FIG. 7, a guide plate 76 is provided to extend from the upper end of the side wall 78 substantially in parallel to the moving path of the recording paper. This guide plate may be omitted. The width (length in the moving direction of the recording paper) of the guide plate 76 is about 25 mm. The relation between the size of the opening 74 and the sectional area of the cross-section of the passage 72 is the same as that in the first embodiment.

The suction unit 82 is provided with a recovery unit (not shown) for recovering the liquid toner contained in the dry air.

As described above, since the suction type drying device is used, it never occurs that the recording paper rises upward by the pressure of the dry air, and therefore, the pressure roll **4*b*** in the first embodiment may be omitted. Further, in place of the vacuum suction unit in the first embodiment, as a unit for removing excess liquid toner, a contact type knife blade can be used to simplify the apparatus.

I claim:

1. A drying device for use with an electrostatic recording apparatus having means for forming an electrostatic latent image of an image to be recorded on a surface of a recording medium moving through a predetermined moving path and means for developing the latent image by applying a liquid toner to the surface of the recording medium and for drying the recording medium after application of the liquid toner, said drying device comprising:

air blowing means for supplying dry air; and air guiding means for guiding the dry air supplied from the air blowing means so as to cause the dry air to blow against the surface of the recording medium moving through the predetermined moving path and to be exhausted to an outside zone, said air guiding means including means for defining an air passage extending from the air blowing means to the predetermined moving path and means for defining, in cooperation with the recording medium moving through said predetermined moving path, an opening configured to extend in a widthwise direction of the recording medium at a distance substantially corresponding to a maximum width of the recording medium to be processed in the electrostatic recording apparatus and to communicate said air passage with the outside zone thereby causing the dry air, after blowing against the surface of the recording medium to leave the air passage through the opening and pass along the surface of the moving recording medium to the outside zone, the opening having a size sufficiently smaller than a size of a cross-section of the air passage perpendicular to a direction in which the dry air flows through the air passage to regulate flow of the dry air when passing the opening.

2. A drying device according to claim 1, wherein each of the cross-section of said air passage and said opening is a substantially rectangular shape having two parallel sides extending in parallel to a width-wise direction of the recording paper.

3. A drying device according to claim 2, wherein a width between the two parallel sides of the rectangular opening is one half or less of a width between the two parallel sides of the rectangular cross-section of the air passage.

4. A drying device for use with an electrostatic recording apparatus having means for forming an electrostatic latent image of an image to be recorded on a surface of a recording medium moving through a predetermined moving path and means for developing the latent image by applying a liquid toner to the surface of the recording medium and for drying the recording medium after application of the liquid toner, said drying device comprising:

air suction means for drawing external air; and air guiding means for guiding the external air so as to cause the air to blow against the surface of the recording medium moving through the predetermined moving path and to be suctioned by the air suction means, said air guiding means including means for defining an air passage extending from the air suction means to the predetermined moving path and means for defining, in cooperation with the recording medium moving through said predetermined moving path, an opening configured to extend in a widthwise direction of the recording medium at a distance substantially corresponding to a maximum width of the recording medium to be processed in the electrostatic recording apparatus and to communicate said air passage with an outside zone thereby causing the external air, after blowing against the surface of the recording medium to enter into the air passage through the opening, the opening having a size sufficiently smaller than a size of a cross-section of the air passage perpendicular to a direction in which the external air flows through the air passage to regulate the flow of the external air when passing the opening.

5. A drying device according to claim 4, wherein each of the cross-section of said air passage and said opening is a substantially rectangular shape having two parallel sides extending in parallel to a width-wise direction of the recording medium.

6. A drying device according to claim 5, wherein a width between the two parallel sides of the rectangular opening is one half or less of a width between the two parallel sides of the rectangular air passage.

7. An electrostatic recording apparatus comprising:

means for forming an electrostatic latent image of an image to be recorded on a surface of a recording medium moving through a predetermined moving path;

means for developing the latent image by applying a liquid toner to the surface of the recording medium;

air blowing means for supplying dry air; and air guiding means for guiding the dry air supplied from the air blowing means to blow against the surface of the recording medium moving through the predetermined moving path and to be exhausted to an outside zone, said air guiding means including means for defining an air passage extending from the air blowing means to the predetermined moving path and means for defining, in cooperation with the recording medium moving through said predetermined moving path, an opening configured to extend in a widthwise direction of the recording medium at a distance substantially corresponding to a maximum width of the recording medium to be processed in the electrostatic recording apparatus and to communicate said air passage with the outside zone thereby causing the dry air, after blowing against the surface of the recording medium to leave the air passage through the opening and pass along the surface of the moving recording medium to the outside zone, the opening having a size sufficiently smaller than a size of a cross-section of the air passage perpendicular to a direction in which the dry air flows through the air passage to regulate flow of the dry air when passing the opening.

8. An electrostatic recording apparatus comprising:

means for forming an electrostatic latent image of an image to be recorded on a surface of a recording medium moving thorough a predetermined moving path;

means for developing the latent image by applying a liquid toner to the surface of the recording medium;

air suction means for drawing external air; and air guiding means for guiding the external air so as to cause the air to blow against the surface of the recording medium moving through the predetermined moving path and to be suctioned by the air suction means, said air guiding means including means for defining an air passage extending from the air suction means to the predetermined moving path and means for defining, in cooperation with the recording medium moving through said predetermined moving path, an opening configured to extend in a widthwise direction of the recording medium at a distance substantially corresponding to a maximum width of the recording medium to be processed in the electrostatic recording apparatus and to communicate said air passage with an outside zone thereby causing the external air, after blowing against the surface of the recording medium to enter into the air passage through the opening, the opening having a size sufficiently smaller than a size of a cross-section of the air passage perpendicular to a direction in which the external air flows through the air passage to regulate flow of the external air when passing the opening.

9. An electrostatic recording apparatus comprising:

means for forming an electrostatic latent image of an image to be recorded on a surface of a recording medium moving through a predetermined moving path;

means for developing the latent image by applying a liquid toner to the surface of the recording medium;

an air moving means for moving dry air;

air guiding means for guiding the dry air moved by the air moving means for causing the dry air to move between said air moving means and an outside zone and to blow against the surface of the recording medium moving through said predetermined path, said air guiding means including:

a) wall means positioned substantially transversely with respect to the recording medium for defining an air passage extending from the air moving means towards said predetermined path, said wall means being spaced from said predetermined path; and b) an opening defined by at least a portion of the wall means and the surface of the recording medium moving through said predetermined path for allowing the dry air to pass between said air moving means and the outside zone, said opening extending in a widthwise direction of the recording medium at a distance substantially corresponding to a maximum width of the recording medium to be processed in the electrostatic recording apparatus and having a size sufficiently smaller than a size of the cross-section of the air passage perpendicular to a direction in which the dry air flows so as to regulate the flow of the dry air in the widthwise direction of said recording medium when passing said opening.

* * * * *